US005743550A

United States Patent [19]

Frohwein

[11] Patent Number: 5,743,550

[45] Date of Patent: Apr. 28, 1998

[54] ELECTRONICALLY CONTROLLED SAFETY BINDING FOR SKIS AND SNOW BOARD

[76] Inventor: Otto Frohwein, Nadistrasse 12, D-80809 München, Germany

[21] Appl. No.: 387,654

[22] Filed: Jan. 30, 1995

[30] Foreign Application Priority Data

Feb. 12, 1994 [DE] Germany ..... 44 04 537.9
Dec. 23, 1994 [DE] Germany ..... 44 46 260.3

[51] Int. Cl.[6] ..... A63C 9/08

[52] U.S. Cl. ..... 280/612

[58] Field of Search ..... 280/612, 633, 280/618, 611, 617, 809, 816

[56] References Cited

U.S. PATENT DOCUMENTS 4,457,532 7/1984 Knabel ..... 280/612
5,213,358 5/1993 Badura ..... 280/612
5,308,102 5/1994 Bildner ..... 280/612
5,411,283 5/1995 Nowak et al. ..... 280/612
5,498,017 3/1996 Rohrmoser ..... 280/612

*Primary Examiner*—Richard M. Camby
*Attorney, Agent, or Firm*—Foley & Lardner

[57] ABSTRACT

An electronically controlled safety binding opens in response to forces transmitted to a ski boot or a snowboard shoe. The safety binding opens when the transmitted forces exceed a threshold amount. To shorten time for opening the safety binding, the safety binding is provided with a piezoelectric crystal which triggers an ignition of an explosive charge. The explosive charge drives a bolt which causes the safety binding to open at a faster rate.

10 Claims, 15 Drawing Sheets

ELECTRONICALLY CONTROLLED SAFETY BINDING FOR SKIS AND SNOW BOARD

BACKGROUND OF THE INVENTION

Generally, a ski safety binding for down hill riding is opened if the force acting on the binding lock exceeds a certain value. Up to now, the bindings which have been available, are purely mechanical devices. The binding lock consists essentially of a prestressed spring or a bolt kept in position by the prestressed spring. By means of an externally acting force, the spring or bolt position is changed against the spring prestress force. The lock is opened if the spring or bolt lift is large enough to set the boot free. Because the spring or bolt lift must be achieved by a force produced by the rider, the binding lock opening is slow. Thus, the action of the force during a comparatively long time can be dangerous to the rider. Furthermore, the prestress can depend on surrounding conditions. For example, when there is a layer of snow between the ski and boot, the binding could require a larger force to open.

Forces in all three directions can be produced during ski and snow board riding and can in case of an accident lead to moments of different directions acting on the leg bones and on certain sinews, like the Achilles sinew, in the leg and foot areas.

Often, in case of an accident with a snow board, forces acting across to the foot are developed and can cause the breaking of the knee cross bands. Hereinafter, if not particularly differentiated, the term "ski" is used as either "ski or snow board."

SUMMARY OF THE INVENTION

It is proposed to measure these forces electronically by piezoelectric crystals and to open the binding by an electric ignition of an explosive charge (e.g., PETN). With this, the time to measure the force, $\tau_I$=1 μs, and the time to open the binding, $\tau_o$=153 μs, can be achieved. $\tau_I$ is the time constant of the amplifier integrating the electric charge produced by a piezo crystal. $\tau_I$ corresponds to the boundary frequency $f_b=\frac{1}{2\pi\tau_I}$=159.2 kHz in this case. $\tau_o$ is the time to move rod 11, in the case presented below with 53.5 g/cm$^2$mass density, by 3.6 cm, using a PETN charge of 0.11 g mass (cylindrical shape with 0.45 cm diameter and 0.4 cm length) at a distance of 0.2 cm from the rod 11 front face. Thus, if the ski rider goes at a speed of 100 km/h and the ski would all of a sudden stop completely, maybe because the ski hits something fixed to the slope, the head of a 1.8 m tall rider would move only 0.4 cm in forward direction (the legs would move less) before the novel ski safety binding would be opened having disconnected the rider from the ski, thus, preventing any damage to the riders' bones and sinews.

BRIEF DESCRIPTION OF THE DRAWINGS

The safety binding is described below more thoroughly with reference to the drawings in which.

DETAILED DESCRIPTION OF THE PREFERRED EMBODIMENTS

Figure 1A:
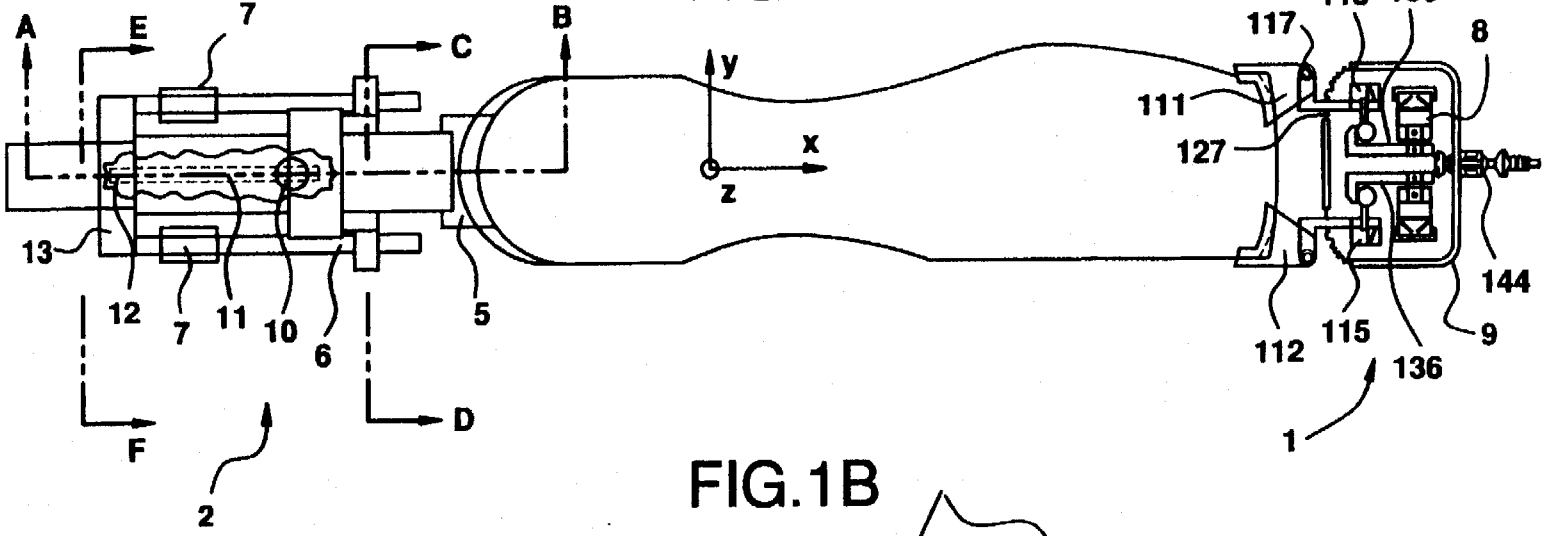
FIGS. 1*a* and 1*b* illustrate respectively the top and side views of a ski safety binding according to the invention.

The proposed binding consists of a front (head) 1 and a rear part (heel holder) 2 by means of which the boot is fixed to the ski. The piece 111 of part 1 is fixed via the axis 117, the piece 127 and the axis 113 to the ski. Analogously, the piece 112 is fixed via the axes and piece which are symmetrical to 117, 127 and 113 with respect to the z-x plane of the ski. Part 2 is movable in the x direction on the track 6 mounted to the ski. Part 2 and the holding piece 5 are kept in place by two springs 7 mounted at one end to the plate 83 (see FIG. 3*a*) of part 2 and at the other end to the ski. When the boot is fixed to the ski, part of the shoe sole is within the notches of the pieces 111, 112 and 5. The boot is pressed between part 1 and piece 5 by the force $F_1$ produced by the springs 7. $F_1=F_{1x}\approx mg/2$, where m is the mass of the rider.

Figure 1B:
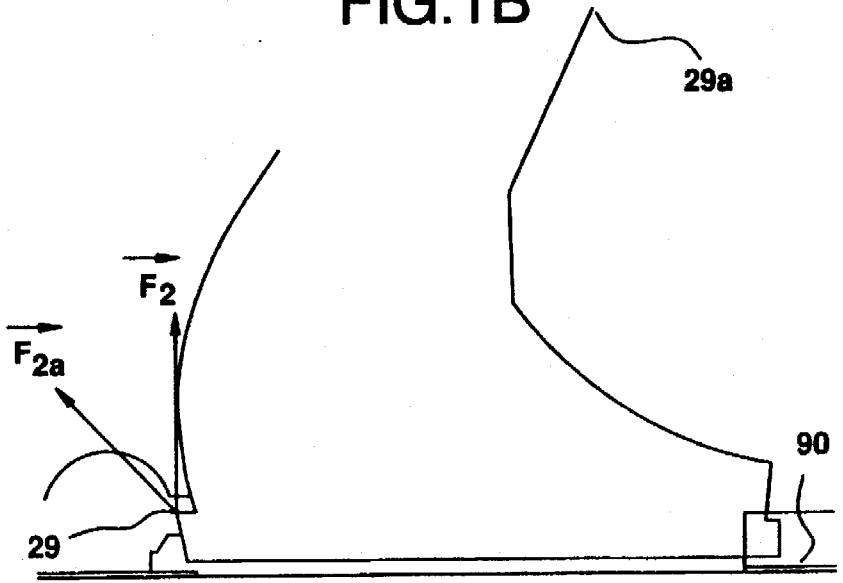
Figure 6A:
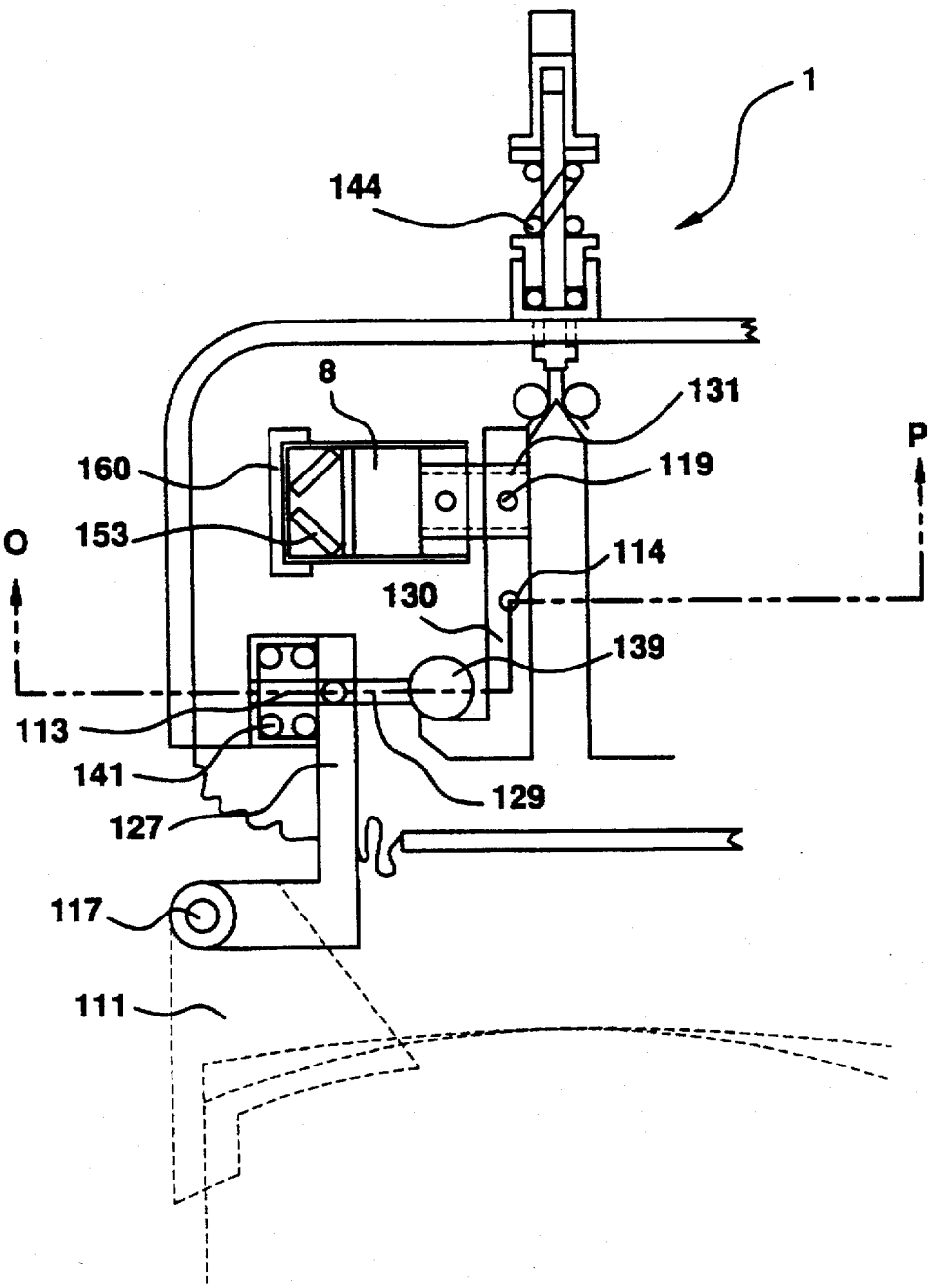
FIG. 6*a* illustrates a mechanical release of a front part of the ski safety binding.
Figure 6B:
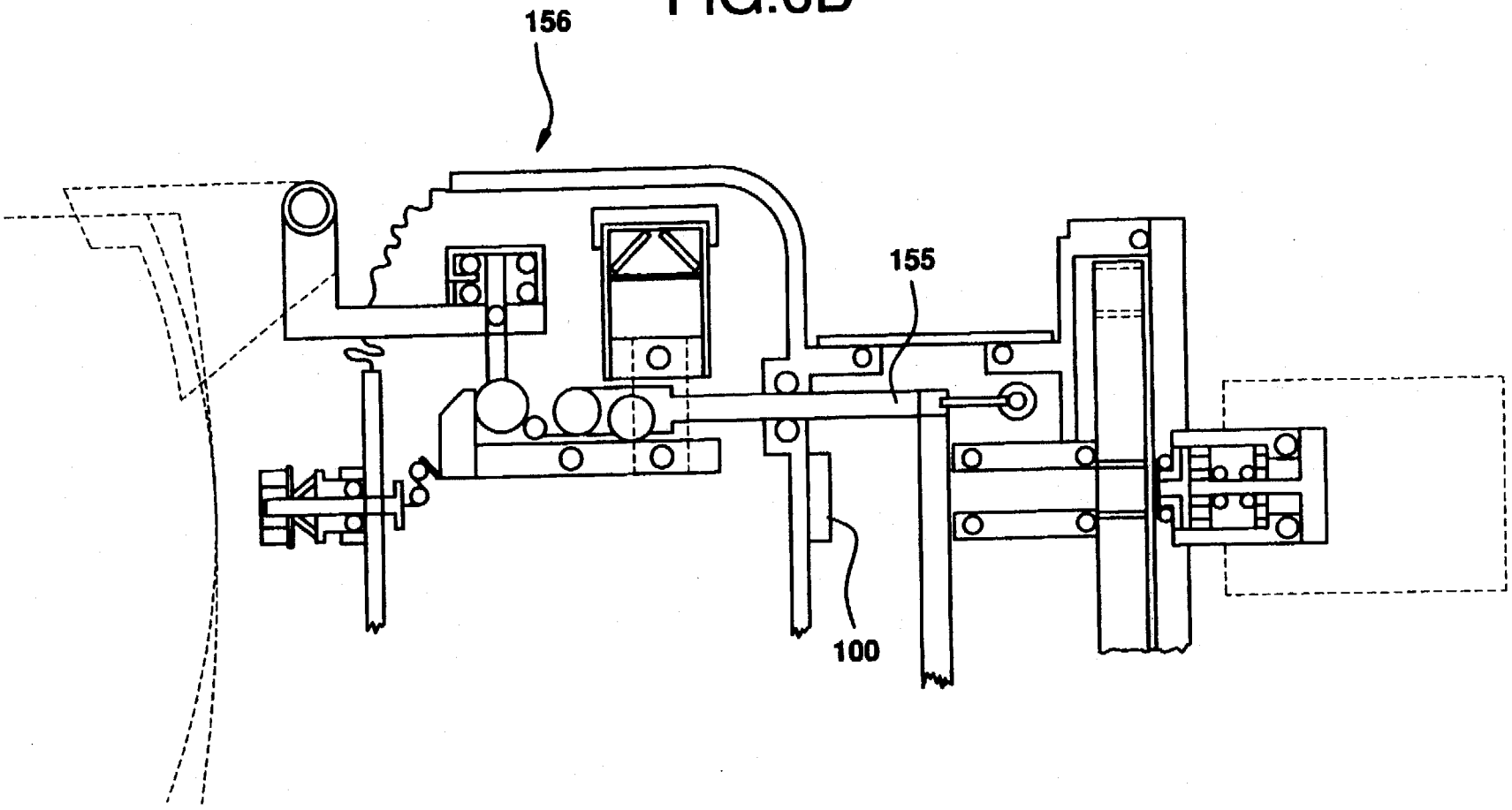
FIG. 6*b* illustrates a electronic and mechanical release one the front part of the ski safety binding.

Part 1, which is now described with reference to FIGS. 1*a*, 1*b* and 6*a*, is symmetrical with respect to the z-x plane. Piece 111 is turnable around axis 117 which is fixed to piece 127. Piece 127 has the axis 113 which is turnably suspended on the plate 90 (see FIG. 1*b*) which is fixed to the ski. In case of a head with an electronic and mechanical release (see FIG. 6*b*), the part 156 is movable in the x direction on a track which is mounted to the ski. The part 156 is kept in place by damping springs.

Figure 6C:
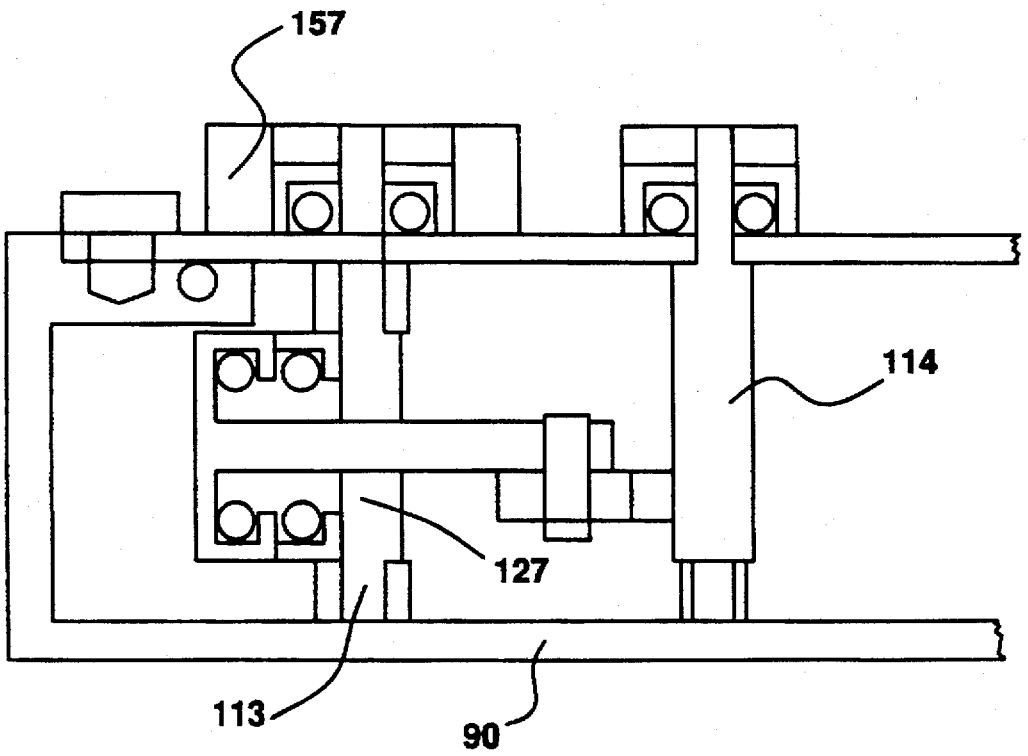
FIG. 6*c* is a sectional view of the front part of the ski safety binding taken along line O–P of FIG. 6*a*.
Figure 7A:
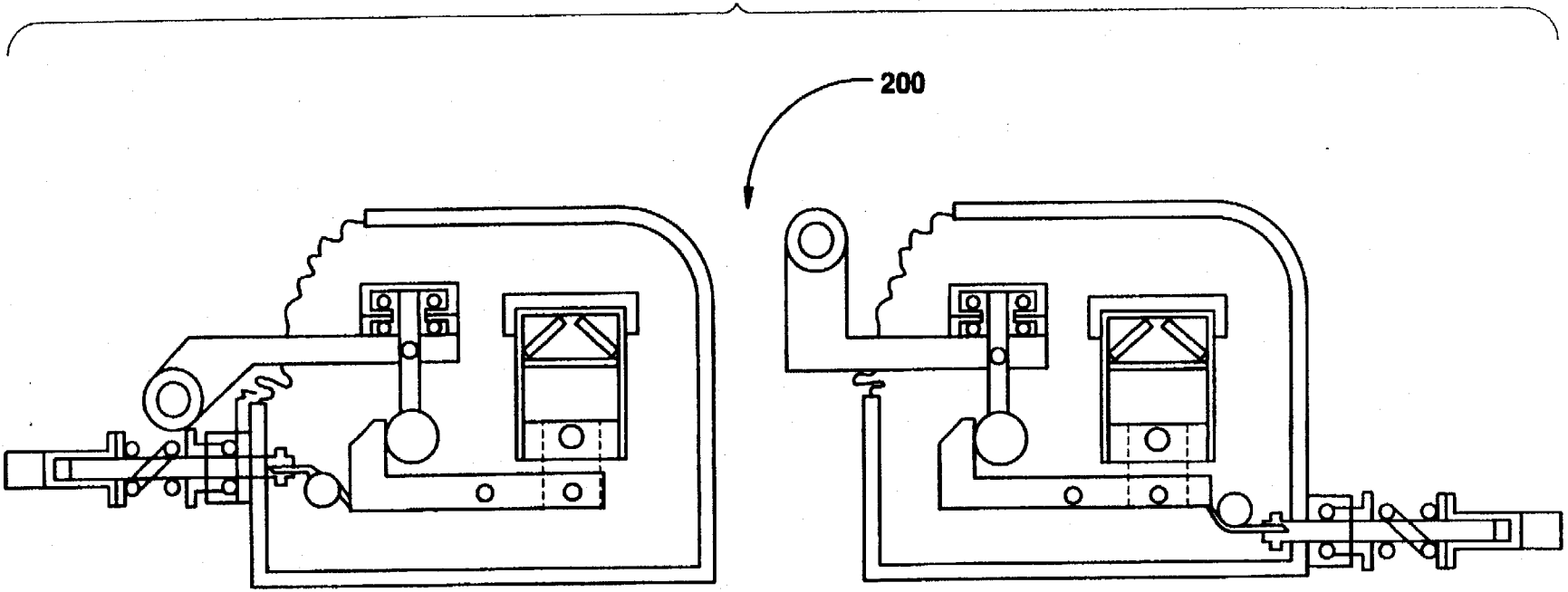
FIG. 7*a* illustrates a mechanical release of a front part of the snow board safety binding.
Figure 7B:
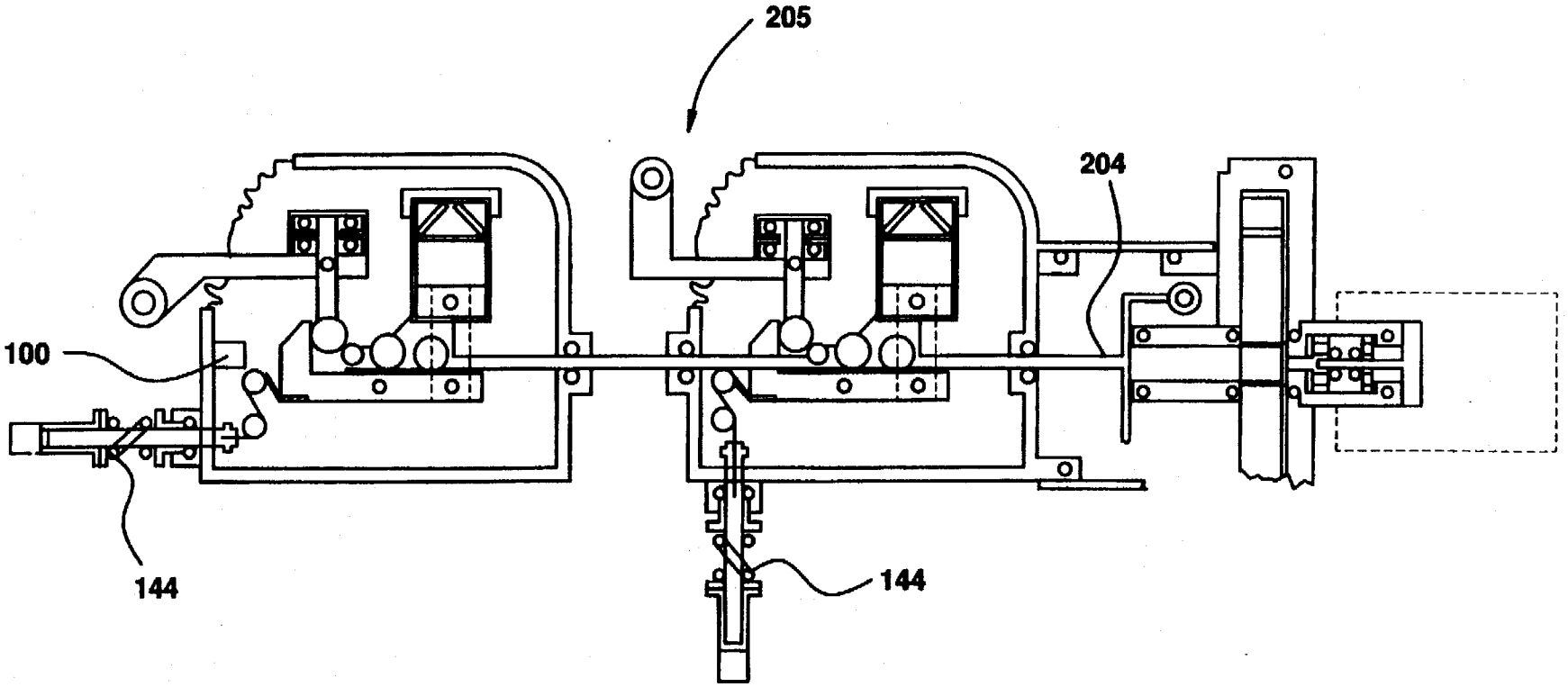
FIG. 7*b* illustrates a electronic and mechanical release of the front part of the snow board safety binding.
Figure 7C:
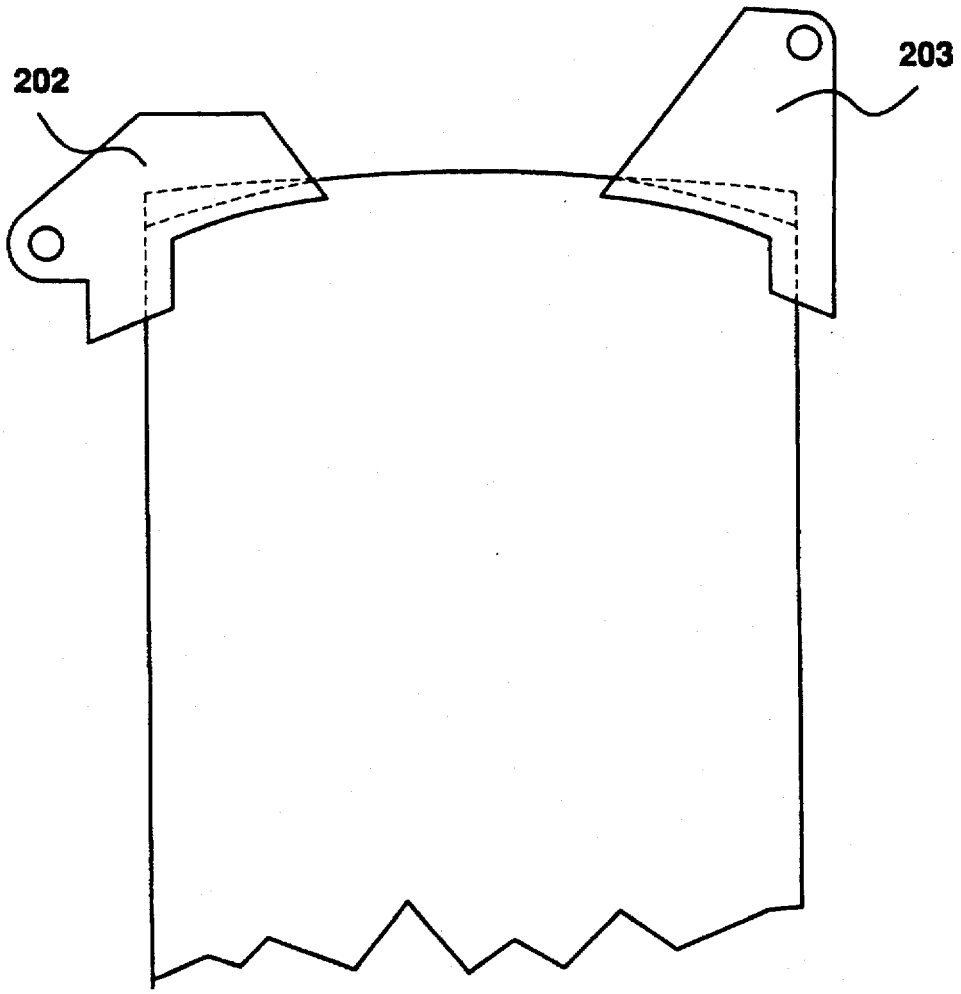
FIG. 7*c* is a top view of the front part of the ski binding.

By means of piece 131 which is turnably suspended around axis 119 being fixed to the lever 130, forces acting on piece 111 in the x-y plane are transferred via the piece 127, the spring 141 and the roll 139 loaded by the locking rod 129 to the piezoelectric crystal 8 connected via the spring 153 to piece 160 which is fixed to plate 90. The lever 130 has the axis 114 which is turnably suspended on the plate 90. Analogously, forces acting on piece 112 are transferred to the piezoelectric crystal 9 which is also connected to the plate 90 via a spring. By means of two springs 157 (see FIG. 6*c*) on the axes 113 and 115 the pieces 111 and 112 are turned into the "open" position when the head is in the "open" state.

The heads 1 and 156 are mechanically opened by inclining the lever 130 or 136 or both by forces acting on the pieces 111 or 112 against the restoring force of the adjusting spring 144. Because of the inclination of 130, the locking rod 129 is moved outside, thus, unlocking the piece 111 of the head. Analogously, the piece 112 is unlocked by inclining the lever 136.

The head 156 is electronically opened by moving 129 and the corresponding symmetrical rod outside by means of the explosive driven bolt 155 motion in the –x direction.

Referring to FIGS. 4, 5 and 7*a*–7*c*, the snow board safety binding heads 200 and 205 are analogously opened. By means of forces acting on the pieces 202 and 203, the heads 200 and 205 are mechanically opened. In addition, the head 205 is electronically opened by the motion of the explosive driven bolt 204. The head 205 is movable in an x direction (see FIG. 4) on a track mounted on the snow board and is kept in position by damping springs.

Figure 4:
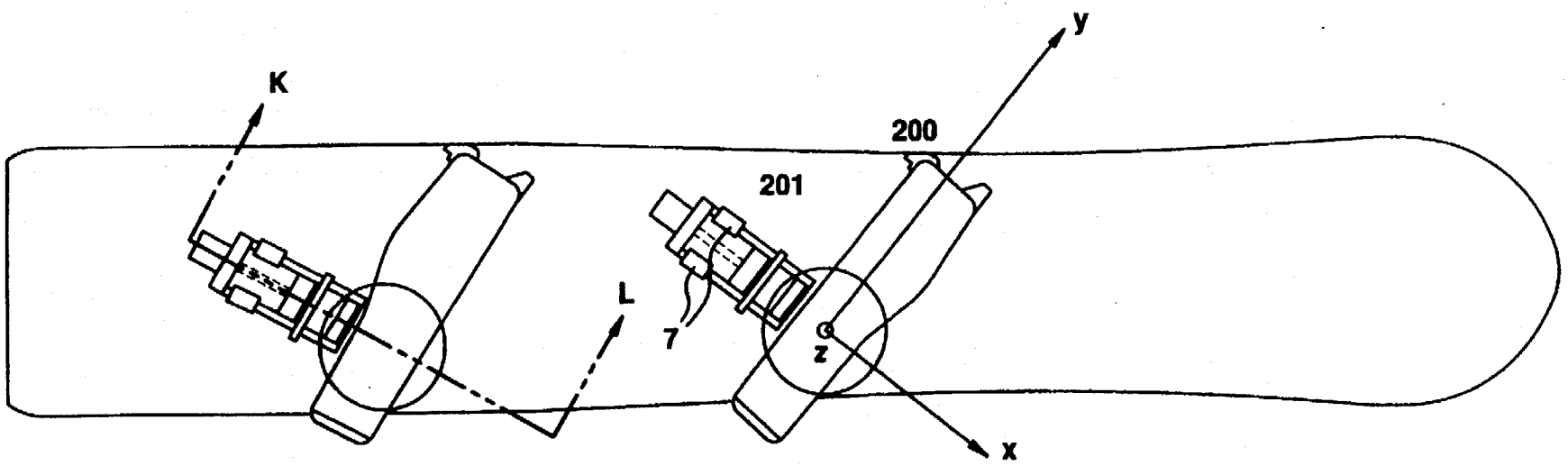
FIG. 4 is a top view of a snow board safety binding according to the invention.
Figure 5:
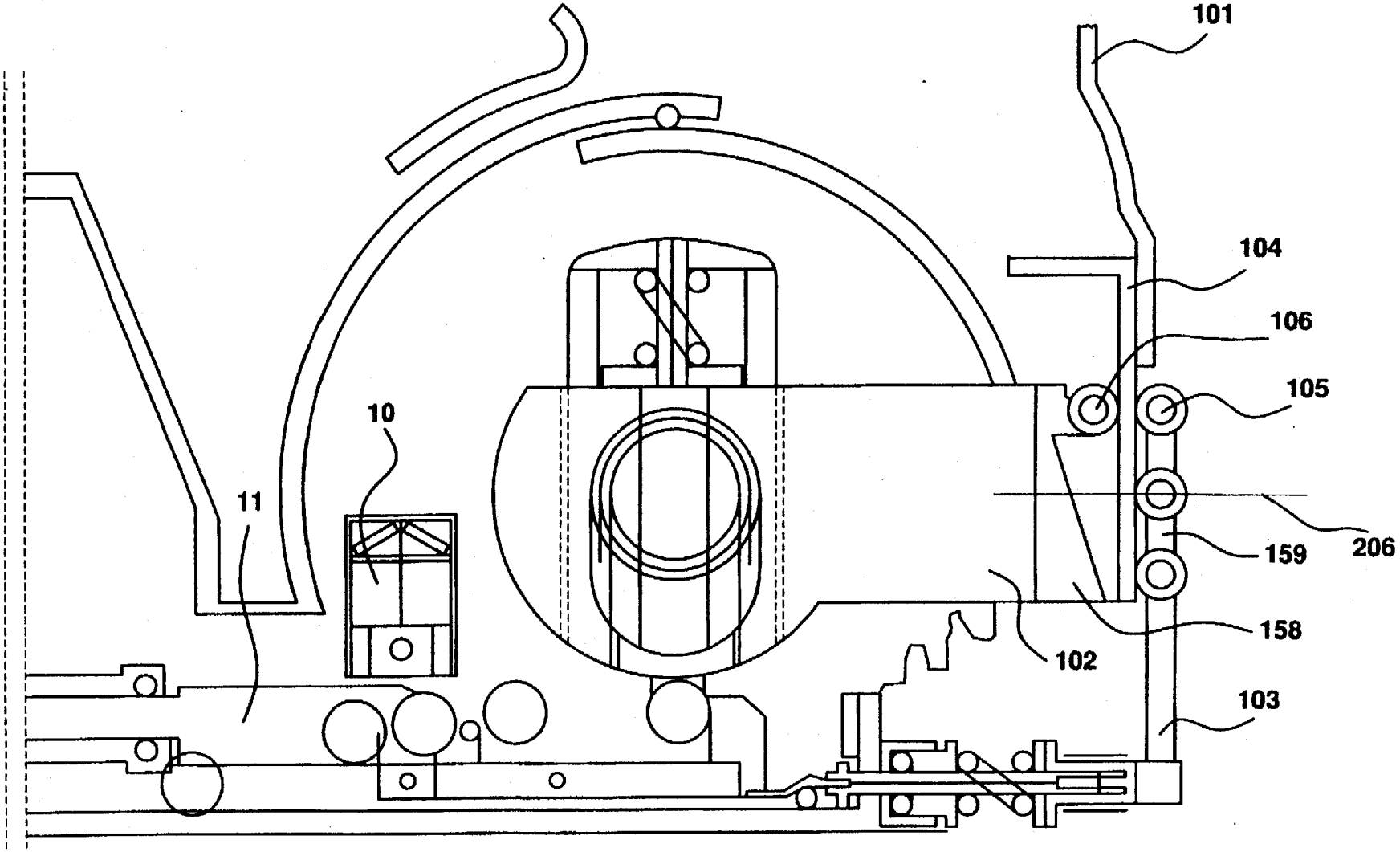
FIG. 5 is a sectional view of a heel holder of the snow board safety binding taken along line K–L of FIG. 4.

The parts 1, 156, 200 and 205 are protected by a metal case with a rubber gasket (not shown in FIG. 1 and 4).

By fast down hill riding and, especially, when the rider falls down in case of an accident, forces due to inertia or unnatural positioning of the rider relative to the ski, can act in all three directions via femur, knee, tibia and fibula, and foot link on the binding parts 1 and 2. If the forces are not released, in our case by displacing the piece 5 of part 2 and turning of the piece 127 and the corresponding piece symmetrical to the z-x plane of part 1, the forces will cause the breaking of one or more of these bones or sinews connecting them, when the corresponding breaking moment is exceeded.

For electronic opening it is sufficient to displace piece 5, if the free space for the boot to move backward, i.e., in the –x direction, is larger, e.g., 1.2 cm in our case, than the depth of the boot sole within the notches of 111 and 112 (see FIG. 1*a*) being, e.g., 0.3 cm. For the electronic opening of the snow board binding it is sufficient to displace piece 102 of the rear part 201 and to loosen the fixing belt 101. An additional electronic opening of the heads of the ski and snow board binding, like at locations 156 and 205, is possible.

The forces acting on the pieces 111, 112 and 5 (or 202,203 and 102 in case of the snow board, respectively) are measured electronically by the piezoelectric crystals 8, 9 and 10. If the force measured by one crystal or the sum of two forces measured by the crystals 8 and 9, exceeds (force to the ski comes from ahead, i.e., –x direction) or is below (force to the ski comes from behind, i.e., x direction) a certain value, piece 5 is displaced by the motion of rod 11 driven by the explosive charge 12 of the magazine 13. For example, the maximum tibia elastic bending moment $M_b$ at the point 29*a* (FIG. 1*b*) which is ⅓ of the tibia length away from the tibia end, is 132.3 Nm and 222.3 Nm for a 7 cm and 9 cm tibia head diameter, respectively. The corresponding values for the breaking moments are 173.5 Nm and 306 Nm (E. Asang, G. Wittmann, Medizin und Sport XIII (1973) H.8). In the case of an accident, where the rider is bent forward, the force $F_2$, which is transferred to the piezoelectric crystal 10 (see below), is $$F_2 = M_b \cdot \frac{\cos(F_2, F_{2a})}{|\bar{r}_{29} - \bar{r}_{29a}|}.$$

For a 6½ size boot $F_2 = M_b \cdot 2.067$ N results, i.e., if $F_2$ exceeds 273.4 N and 459.4 N for the above tibia head diameters, respectively, the binding must be opened.

Figure 2A:
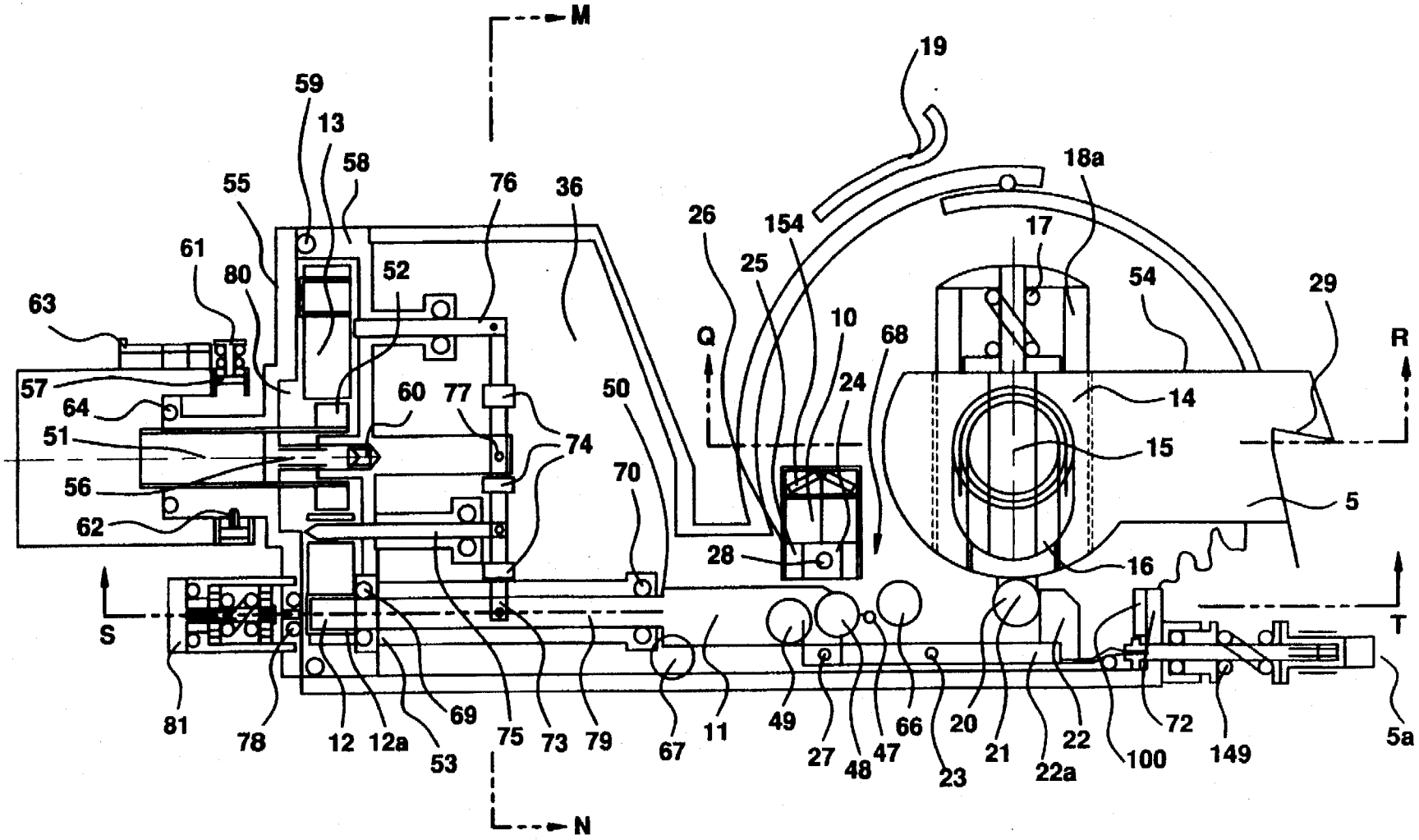
FIG. 2*a* is a sectional view of a heel section of the ski safety binding taken along line A–B of FIG. 1*a*.
Figure 2B:
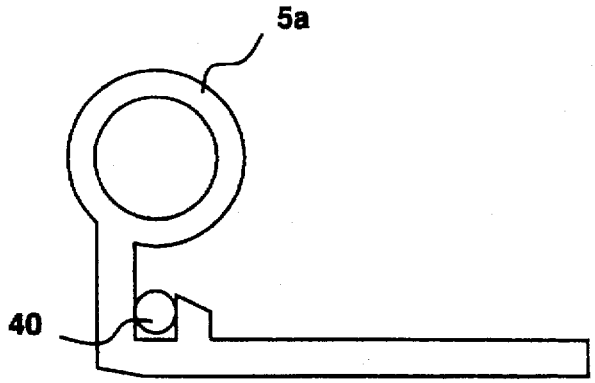
FIG. 2*b* illustrates a heel piece of the heel section.
Figure 2C:
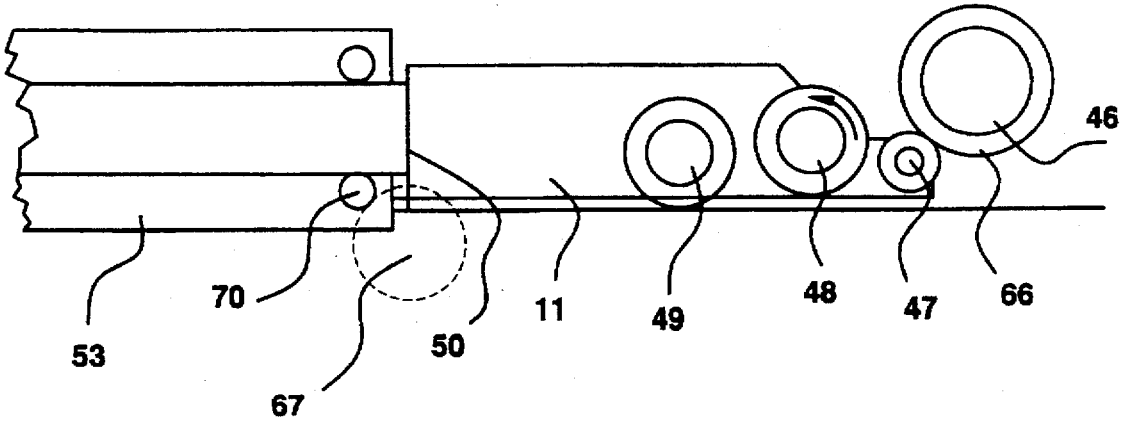
FIG. 2*c* illustrates an opening rod of the heel section.
Figure 2D:
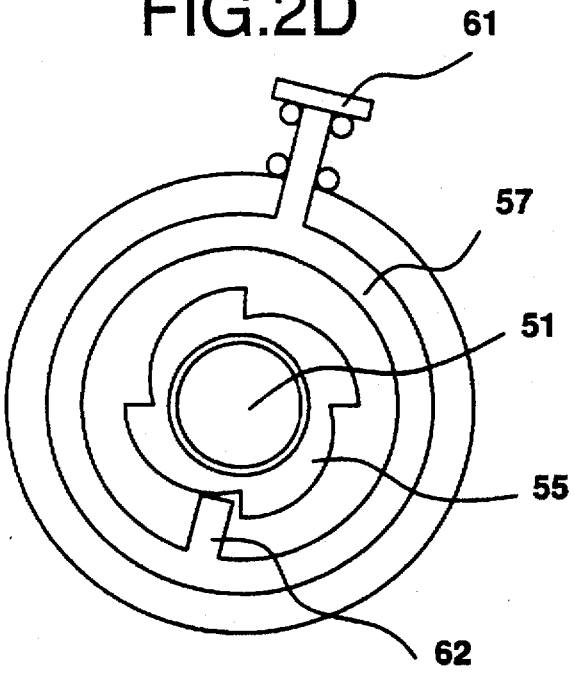
FIG. 2*d* is a sectional view of the heel section taken along line E–F of FIG. 1*a*.
Figure 2E:
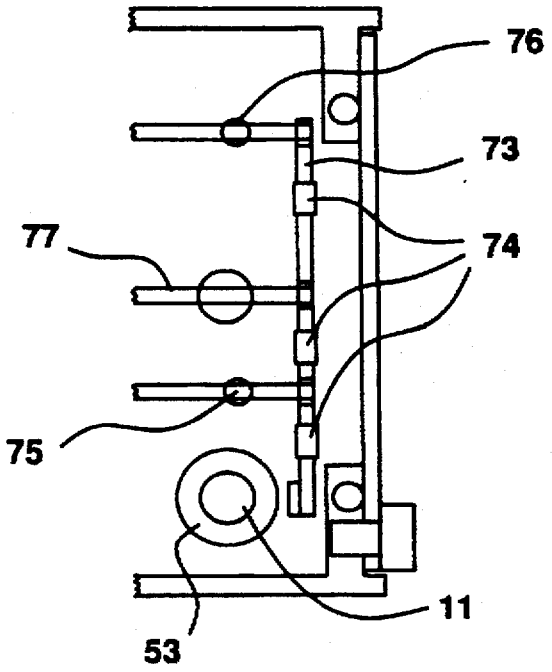
FIG. 2*e* is a sectional view of the heel section taken along line M–N of FIG. 2*a*.
Figure 2F:
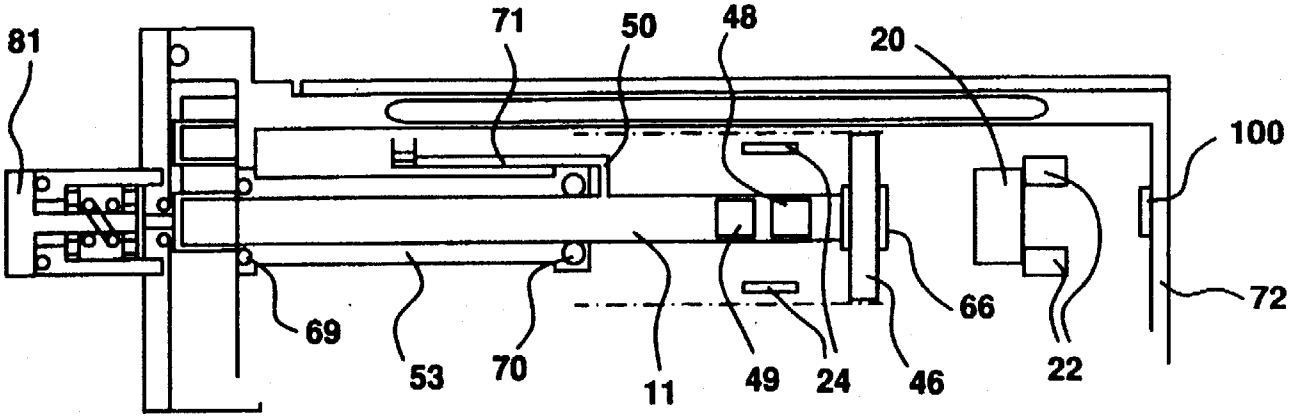
FIG. 2*f* is a sectional view of the heel section taken along line S–T of FIG. 2*a*.
Figure 2G:
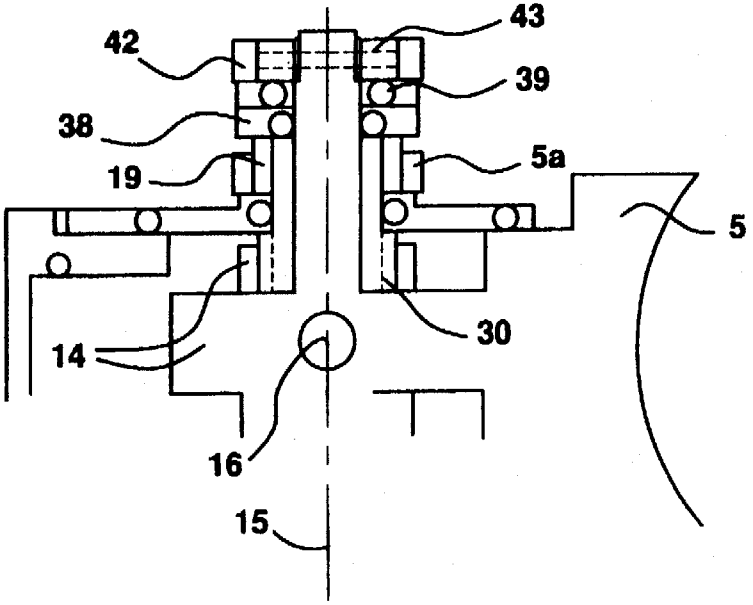
FIG. 2*g* is a sectional view of the heel section taken along line Q–R of FIG. 2*a*.

FIG. 2*a* shows the section A–B of part 2 in the z-x plane. The heel of the boot is kept in place by the heel cap 5 connected to the heel cap locking device 14. The heel cap 5 and the heel cap locking device 14 are turnable around the axis 15. In the normal open position of the binding before stepping in, the heel cap 5 and heel piece 5*a* (also turnable around the axis 15, FIG. 2*b*, see below) have an angle of 60° and 65° towards their closed position, respectively. In other words, with respect to the x axis, the angle of the edge 54 of the heel cap 5 is 60° and the angle of the long part of 5*a* is 65°. Pieces 5, 14 and 5*a* are kept in the open position by a spring (42, see FIG. 2*g*). In order to close the binding, the heel piece 5*a* is pressed down by the heel of the boot bringing the long part of the heel piece 5*a* into a horizontal position parallel to the x axis and the edge 54 into a position inclined by –5° with respect to the x axis.

During this turn the cylindrical rod 16, which is sliding within a transverse hole through the heel cap locking device 14, with a wheel (or roll) 20 at one end, and is kept down by the spring 17, is moved up, to overcome the widening of a lever 22. After pressing down, the rod 16 freely slides back into the down position, since the axis of the rod 16 has an angle of –95° towards the x axis, whereas in the closed position this angle is only –90°. The binding is locked by means of the rod 16 and wheel 20. The small wheel 20 (e.g., 0.6 cm diameter) at the lower end of the rod 16 is turnable around the axis 21. In the locked position, the wheel 20 is pressed to the edge 22*a* of the lever 22 which is turnable around the axis 23. The lever 22 is connected by the splitted piece 24 to the cylindrical piece 25 which presses against the crystal 10 from below. The crystal 10 is kept in place via the spring 154 by the cylindrical piece 26. The cylindrical piece 25 is movable along the z axis within the cylindrical piece 26. The splitted piece 24 is turnably suspended on the axes 27 and 28 fixed to the lever 22 and the cylindrical piece 25, respectively. Thus, the force $F_2$ (see FIG. 1*b*) is transferred to the crystal 10 and the spring 154 via pieces 14, 16, 20, 22, 24 and 25 yielding $F_3$. $F_2$ is produced by the rider acting on 5 at point 29 in a direction which lies in the z-x plane and is perpendicular to the position vector ($\bar{r}$29–$\bar{r}$15) (vector between point 15 and 29). $F_3$ acts along the z direction on 10. $F_3$ is given by $$F_3 = \frac{a_1 a_3}{a_2 a_4} \cdot F_2, \tag{1}$$

where $a_1$ is the length of ($\bar{r}$29–$\bar{r}$15), $a_2$ the z component of ($\bar{r}$21–$\bar{r}$15), $a_3$ the z component of ($\bar{r}$21–$\bar{r}$23), and $a_4$ the x component of ($\bar{r}$27–$\bar{r}$23). E.g., with $a_1$=3.85 cm, $a_2$=2.0 cm, $a_3$=0.8 cm and $a_4$=1.5 cm, $F_3$=1.03 $F_2$ results, i.e., $F_3$ and $F_2$ have about the same size. $F_3$ can be made different in a wide range in order to match requests for the crystal 10 by changing the x coordinate of 23, thus, varying $a_4$ and $F_3$ according to eq. 1.

Normally, i.e., without an explosive charge, the binding is opened by lifting the inner part 18 of the heel cap locking device 14 including the suspension device 18*a* of the spring 17 in the transverse direction to the axis 15 by means of tooth wheels 30 (see FIG. 3*a*) turnable around the axis 15 acting on corresponding teeth in the inner part 18. The tooth wheels 30 are driven by the lever 19 which is kept in the up position close to the prolonged axis of the rod 16 by a spring 38 (see FIG. 3*a*), thus, holding the inner part 18 down.

Figure 2H:
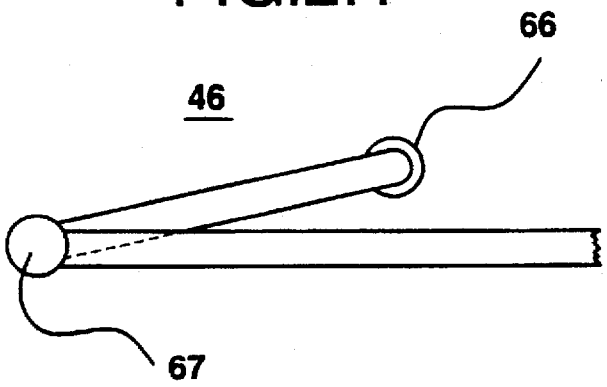
FIGS. 2*h* and 2*i* illustrate respectively the side and top views of an opening lever for the heel section.
Figure 2I:
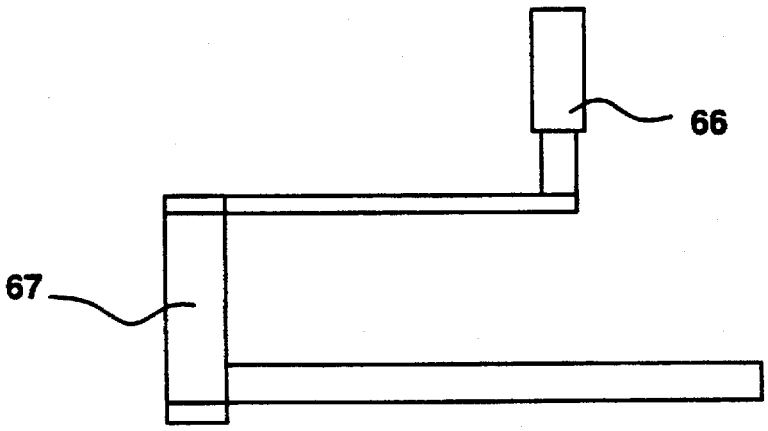

Another rod 11 has an inclined plane at one end with wheels 47 and 48, and is easily movable on the bottom piece 83 (see FIG. 3*a*) by means of the wheel 49. The wheels 47 and 48 are mounted close to each other and close to the bottom piece 83 without touching (see FIG. 2*c*). In the normal position, the wheel 47 touches the wheel with the axis 66 of the heel piece opening lever 46 (see FIG. 2*a*, 2*h*, 2*i*). The axis 66 is connected on both sides of the rod 11 in y direction to two axes 67 of the lever 46 by two rods. The two axes 67 are part of two feedthroughs through the case 35 (see FIG. 3*a*). Outside of the case 35, the two long heel piece bolt lifters of the lever 46 are rigidly connected to the two axes 67. By means of the heel piece bolt lifters the bolts 40 of the heel piece bolt device –39 are unlocked.

When the binding is opened by means of the detonation of the charge 12, the rod 11 is driven by the shock waves of the explosive gases developing in piece 79, within the metal cartridge 12*a* and the tube 53, both tightly connected by the tightening ring 69. The recoil momentum of the moving rod 11 is taken up by the springs 7, i.e., the heel cap 5 and parts connected to the heel cap 5 move in the –x direction on the track 6 against the prestress force of springs 7. The tightening ring 70 prevents as a sliding seal between the tube 53 and the rod 11, the explosive gases from floating into the inner space 36. First, the axis 66 is lifted by the wheels 47, 48 and the rod 11 to the position 68, thus, lifting the bolts 40 by means of the lever 46 and leaving the heel piece 5*a* down.

For a given bolt lift $h=(z_{40a}-z_{40})$(see FIG. 3*a*) at $x_{15}$ $(x_{15}-x_{67})$, the distance of the axes 67 from the plane $x=x_{15}$ is given by $$(x_{15}-x_{67})=\frac{(x_{15}-x_{68})\cdot h}{h-(z_{68}-z_{66})}\ .$$

E.g., with h=0.8 cm, $(z_{68}-z_{66})$=0.5 cm and $(x_{15}-x_{68})$=1.7 cm $(x_{15}-x_{67})$=4.53 cm results.

When the rod 11 proceeds further, the wheel 20 is raised by the wheels 47, 48 and the rod 11 over the edge 22*a*, thus unlocking the binding. The heel cap 5, the heel cap locking device 14 (and 18) are brought to the open position very quickly by the moving rod 11 with teeth on the upper side of the rod 11 fitting into teeth at the circumference of the heel cap locking device 14 along 60° of arc. Only half of the width of the rod in the y direction has teeth worked into, with the other half being flat at a height equal to the top of the teeth. Therefore, the wheel with axis 66 runs smoothly on the rod 11. The teeth on the heel cap locking device 14 circumference have a corresponding width in the y direction. After a lift of 3.6 cm, e.g., the rod 11 stops by the wheel 47 hitting the wall 72 being protected by a rubber cushion 100. Piece 18*a* does not touch the cylindrical piece 26 because of the sensitive crystal 10.

At position 50 the shape of the rod 11 cross section is changed from rectangular into cylindrical, thus, matching the cylindrically shaped explosive charge 12 positioned at the other end of the rod 11. The charge 12 is one of, for example, 16 charges, equally spaced by an angle of 22.5° between each other, within the magazine 13 turnable around the axis 51. Furthermore, there are two pieces 71 outside the tube 53 on both sides of the rod 11 in the y direction which are fixed to the rod 11 at position 50 on one side (see FIG. 2*f*). On the other side, the two pieces 71 are turnably connected to two rods 73, which are turnably connected to the axis 77 and of which each is subdivided by three springs 74. The two rods 73 are turnably connected to two cylindrical rods 75 and 76, which are guided in tubes sealed by tightening rings. The rod 75 fits into a hole of the magazine 13 fixing its position.

When the rod 11 has left its normal position after the ignition of the charge 12, the cylindrical rod 75 is out of the hole. Therefore, the magazine 13 will start to rotate around the axis 51 after the pressure, due to the explosion, of the cartridge against the tightening ring 78 has fallen because of the expansion of the gas in 79.

At the same time, the cylindrical rod 76 has moved into a saw tooth shaped frame of the magazine 13, thus, blocking the magazine 13 after a rotation of 22.5°, where the next charge is in the position of the charge 12. During the rotation, the ring 69 is no longer tight and the gas enters the space 80 from where it is released into the open air or into a small balloon through the pressure valve 81. The valve 81 opens slightly above the atmospheric pressure.

The magazine 13 is driven by the spring 52 wound around the axis 51. The spring 52 is within a square shaped case which fits into the plastic frame of the magazine 13.

The inner space 36 is tightened against outside by pressing the end plate 55 against the tightening ring 59 of case 58 by turning the wing screw 56 into the winding 60, thus, simultaneously prestressing the spring 52 because the square shaped case of the spring 52 does not turn. During the turning of the wing screw 56, the spring 52 moves within the notch of the magazine 13, e.g., by 4 mm in the x direction, the lift of the wing screw 56 winding within the winding 60.

The device 57 prevents the wing screw 56 from turning backward because of the prestressed spring 52. The device 57 consists of a ring movable within a guidance connected to the wing screw 56 only along one straight line perpendicular to the axis 51 in the up and down direction (away and towards the axis 51). On two opposite sides there are pieces 61 and 62 attached to the ring. The piece 61 is kept in the up position by a spring, thus, keeping the bolt 62 in the down position pressing on an asymmetric saw tooth shaped surface of the end plate 55 (see FIG. 2*d*). Everytime when the bolt 62 crosses a hill of the surface, the turn in the reverse direction is blocked.

In order to remove the end plate 55 for replacing the magazine 13, the piece 61 must be pressed down and fixed in this position by the lever 63, thus, removing the bolt 62 from the end plate 55 surface and releasing the reverse turn lock.

After the magazine 13 is empty, having made one turn, the prestress of the spring 52 is one turn less. At a 0.5 mm slope of 60, 8 turns are necessary to remove the end plate 55. That is, one additional turn must be taken up by the spring 52. By means of the tightening ring 64, the inner space 36 is tight against outside after closing the wing screw 56. The pieces 61, 62 and 63 must be protected by a kapton foil cover.

Figure 3A:
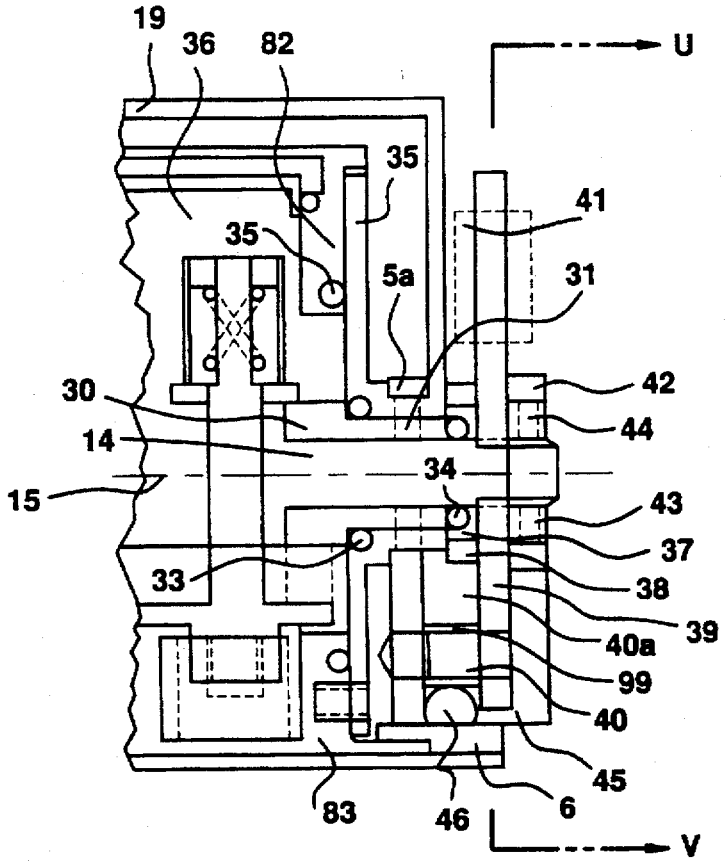
FIG. 3*a* is a sectional view of the heel section taken along line C–D of FIG. 1*a*.

FIG. 3*a* shows the section C–D of part 2 (see FIG. 1*a*) parallel to the y–z plane. The figure is symmetrical corresponding to the axis of the rod 16. The inner space 36 is tightened against outside by means of the tightening ring 32 and e.g., 16 screws 82 (M4, Allen). The bottom piece 83 slides within the track 6. The two tooth wheel pieces 30 are driven by the lever 19 which is connected to the tooth wheel pieces 30 by a series of bolts 31 around the circumference. The bolts 31 are short enough not to touch the heel cap locking device 14 at the inner end and the heel piece 5*a* at the outer end. Two tightening rings 33 and 34 at the inner case wall 35 and the tooth wheel piece 30 make the inner space 36 tight against outside even if the tooth wheel piece 30 or the heel cap locking device 14 are turned around the axis 15. On top of the ring 37 which presses the tightening ring 34 against the tooth wheel piece 30, there is the spring 38 wound around the axis 15. One end of the spring 38 is fixed to the lever 19 and the other end to the heel cap locking device 14 via the heel piece bolt device 39, thus, keeping the lever 19 in the up position.

Figure 3B:
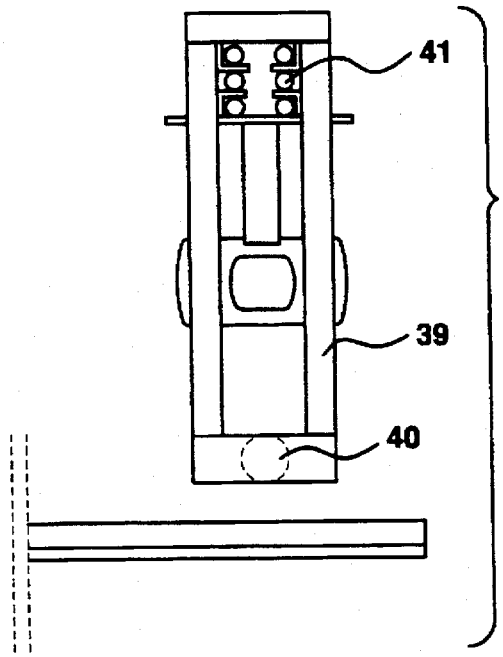
FIG. 3*b* is a sectional view of the heel section taken along line U–V of FIG. 3*a*.

The heel piece bolt device 39 is fixed to the heel cap locking device 14 by a groove (see FIG. 3*b*). At one end of the heel piece bolt device 39 there is a bolt 40 locked to the heel piece 5*a*. The bolt 40 is along the axis of the wheel 99. The bolt 40 is kept in the down position by the spring 41 at the other end of the heel piece bolt device 39. When the bolt 40 is lifted by piece 46 into the position 40*a* (shifted upward in the z direction by means of the explosive charge driven rod 11, see FIG. 2*a*), the bolt 40 is unlocked from the heel piece 5*a* (see FIG. 2*b*), thus, keeping the boot down while the heel cap 5 is slightly afterwards lifted also by the rod 11. Piece 37 is pressed against the ring 34 by the nut 43 at the end of the heel cap locking device 14 via the heel cap bolt device 39. The nut 43 is screwed on the heel cap locking device 14 producing a force along the axis 15. The nut 43 is fixed by means of the bolt 44 feeded through one of, e.g., eight holes of the nut 43 and one hole of the heel cap locking device 14 perpendicular to the axis 15.

On top of the nut 43 there is spring 42 wound around 15. One end of the spring 42 is connected to the nut 43 and the other end via piece 45 to the track 6, thus, keeping the heel cap locking device 14 (and 5) without boot in the up position.

Piece 14 is tightened against outside by a kapton foil sheet drawn in FIG, 2*a* and a kapton sheet side cover not drawn.

The snow board safety binding consists, as the ski safety binding, of a front and a rear part, 200,205 and 201, respectively (see FIG. 4, 7*a–c*), by means of which the shoe is fixed to the snow board. Both parts are, if not particularly differentiated, identical with those of the ski safety binding. For example, the snow board binding contains also the springs 7 (see FIG. 4), by means of which the backstroke of the explosive driven bolt 11 is taken up. The heads 200 and 205, respectively, are, apart from the holding pieces 202 and 203, mounted below the shoes (see FIG. 6*c* for the height of the show above the snow board).

The rear part 201 is mounted on the snow board at the right side of each shoe, if the left shoe is in front and on the left side, if the right shoe is in front. The fixing belt 101 (see FIG. 5) is connected to the wedge shaped piece 104. The wedge shaped piece 104 is pressed by the springs 7 via the displaceable piece 102 against the rolls 105 which are mounted at piece 103. Because of the rolls 105 and 106, the wedge shaped piece 104 and the fixing belt 11 can be easily locked and fastened, respectively. The fixing belt 101 is opened by means of the bolt 11, where the displaceable piece 102 is turned upwards after opening the locking device consisting of pieces 22, 22*a*, 21, 16, 17, 18 and 18*a*. The forces acting on the fixing belt are measured by the piezoelectric crystal 10.

All electronics can be mounted together with a rechargeable battery set in part 1 (see FIG. 1*a*) of the binding. An electronics system must contain three amplifiers integrating the charge of the piezo crystals 8, 9 and 10, a control system by means of which the decision is made whether the binding must be opened or not, and a device (IVD) to produce the charge ignition voltage (ca. 500 V).

A more simple control system (I) consists essentially of a specific hardware, like potentiometers with analog lightband indication, analog adder and subtractor, comparators, discriminators and coincidence circuits.

From U, which is the individual signal of 8, 9 or 10 (U(8), U(9), U(10)), or from the sum U=U(8)+U(9), a constant background voltage $U_b$ is subtracted. $U_b$ is measured when the rider is rather little moving, i.e., the variations of U(8), U(9) and U(10) are small. $U_b$ depends on the environment conditions. In case of a snow layer between ski and boot sole, $U_b$ may be large. Thus, $U-U_b$ is proportional to non-stationary forces produced during riding. $U-U_b$ is compared with the voltage $U_p$, preset by hand using a potentiometer. $U_p$ may be taken from a table calibrated using the maximum elastic bending moments of tibia and fibula, tibia head diameter and boot size, or knee cross band maximum load in case of ski or snow board riding, respectively. If $U-U_b=U_p$ holds, the IVD is triggered.

A more sophisticated control system (II) consists of analog digital converters (ADCs) with numeric indicators and a microcontroller. The microcontroller consists, e.g., of a CPU, an EPROM for programs and data, and peripheric modules for I/O etc. Part of the EPROM can be an intelligent subprocessor which accepts available software modules. $U_b$ is determined by a program, e.g., from the constant U contributions. All arithmetic, as $U-U_b$, is done numerically. The $U_p$ table can be stored in the EPROM, read into the CPU and be continuously updated during riding, thus, achieving a self learning binding which adjusts itself, being insensitive to preset data.

In order to prevent that in case of a ski safety binding one ski is left still fixed to one boot, when the IVD of the other binding has been triggered in case of an accident, the IVD of the binding of the remaining ski must be activated, too. That is, a communication between the two logic coincidence circuits of system I or between two peripheric modules of the two microcontrollers of system II must be established. This can be done, e.g., either by a conducting connection via boot and trousers (wire integrated into the trousers legs) or by infrared senders and receivers built into both bindings. In case of the snow board safety binding, this communication is achieved by a conducting connection between the two bindings.

The electronic units (amplifiers, ADCs, microcontroller, etc.) should be of the CMOS type in order to save power.

I claim:

1. An electronically controlled safety binding, comprising:

a hold-down member rotatable about a first axis and biased towards an open position;

a locking rod connected to said hold-down member to be rotatable therewith, said locking rod also being movable axially in a transverse direction with respect to the first axis;

a spring biasing said locking rod against movement in the transverse direction;

a locking roll connected to the locking rod to be rotatable and movable therewith;

a locking lever having a resistance portion pressed against the locking roll for holding said locking rod and said locking roll in a locked position to prevent said hold-down member from rotating into the open position, said locking lever also being rotatable about a second axis in response to forces transmitted to said hold-down member, wherein a first predetermined amount of force transmitted to said hold-down member rotates said locking lever sufficiently to cause said locking roll to move over the resistance portion of said locking lever and release said hold-down member into the open position;

a piezoelectric crystal which triggers, in response to a second predetermined amount of force transmitted to said hold-down member, an ignition of an explosive charge; and a bolt movable in response to the ignition of the explosive charge and adapted to move the locking roll over the resistance portion of said locking lever to release the hold-down member into the open position.

2. An electronically controlled safety binding as recited in claim 1, further comprising a spring biasing said hold-down member towards the open position.

3. An electronically controlled safety binding as recited in claim 1, further comprising a manually-operated opening lever and tooth wheels, operated by said opening lever, for displacing said locking rod and said locking roll in the transverse direction to move said locking roll over the resistance portion of said locking lever to release said hold-down member into the open position.

4. An electronically controlled safety binding as recited in claim 1, further comprising:

a heel piece also rotatable about the first axis and biased towards an open position, said heel piece having a locking groove;

a locking bolt received in the locking groove for keeping said heel piece from rotating into the open position;

a second spring for maintaining said locking bolt in the locking groove; and a heel piece opening lever, in response to the ignition of the explosive charge, for moving the locking bolt against said second spring and out of the locking groove to release said heel piece into the open position.

5. An electronically controlled safety binding as recited in claim 1, further comprising damping springs for absorbing reaction forces resulting from the movement of said bolt in response to the ignition of the explosive charge.

6. An electronically controlled safety binding as recited in claim 1, wherein said hold-down member includes a locking member with a first set of teeth around its circumference and said bolt includes a second set of teeth mating with said first set of teeth.

7. An electronically controlled safety binding as recited in claim 1, further comprising:

a plurality of metal cartridges, each holding an explosive charge and having an inner diameter space in which the bolt can be received; and a magazine in which the metal cartridges are embedded, the magazine being rotatable to align the bolt within the inner diameter of one of the metal cartridges.

8. An electronically controlled safety binding as recited in claim 7, wherein the magazine is prestressed by a spring and biased to rotate in one direction.

9. An electronically controlled safety binding as recited in claim 1, further comprising a snowboard shoe hold-down belt connected to the hold-down member, wherein the forces transmitted to the belt are transmitted to the piezoelectric crystal through the hold-down member.

10. An electronically controlled safety binding as recited in claim 1, further comprising a foil cover protecting the hold-down member and the locking lever.

* * * * *